US007946126B2

(12) United States Patent
Blankman et al.

(10) Patent No.: US 7,946,126 B2
(45) Date of Patent: May 24, 2011

(54) ADJUSTABLE VOLUME TODDLER CUP

(76) Inventors: Cheryl B. Blankman, Newtown, PA (US); Jeffrey I. Blankman, Newtown, PA (US)

( * ) Notice: Subject to any disclaimer, the term of this patent is extended or adjusted under 35 U.S.C. 154(b) by 462 days.

(21) Appl. No.: 12/119,563

(22) Filed: May 13, 2008

(65) Prior Publication Data

US 2009/0283529 A1 Nov. 19, 2009

(51) Int. Cl.
*F25D 3/08* (2006.01)

(52) U.S. Cl. ..... 62/457.3

(58) Field of Classification Search ..... 62/457.1, 62/457.3, 530

See application file for complete search history.

(56) References Cited

U.S. PATENT DOCUMENTS

| | | | | |
|---|---|---|---|---|
| 3,205,677 | A * | 9/1965 | Stoner | 62/457.3 |
| 3,360,957 | A * | 1/1968 | Paquin | 62/457.3 |
| 5,044,173 | A * | 9/1991 | Cheng | 62/372 |
| 6,758,363 | B2 * | 7/2004 | Stokes | 220/592.15 |
| 7,124,603 | B2 * | 10/2006 | Bianco | 62/457.3 |
| 7,175,042 | B2 * | 2/2007 | Durdon | 220/254.3 |
| 7,269,969 | B2 * | 9/2007 | Strickland et al. | 62/400 |
| 2005/0184136 | A1 | 8/2005 | Baynum, III | |
| 2005/0199697 | A1 | 9/2005 | Nugent | |
| 2007/0235461 | A1 | 10/2007 | Ruccolo | |
| 2008/0029518 | A1 | 2/2008 | Mansfield et al. | |

* cited by examiner

*Primary Examiner* — Melvin Jones
(74) *Attorney, Agent, or Firm* — Jeffrey I. Blankman

(57) ABSTRACT

Adjustable volume cups and methods for use are disclosed. Cups of various embodiments may have a series of removable inserts or a moveable bottom member allowing the containable volume to be adjusted.

18 Claims, 8 Drawing Sheets

ADJUSTABLE VOLUME TODDLER CUP

FIELD OF THE INVENTION

The present invention is generally related to the field of toddler cups, and more specifically related to toddler cups with adjustable volumes.

BACKGROUND

There are a lot of toddler cups on the market designed to help a child transition from using a bottle to being able to drink from a regular cup. Even cups designed for the youngest toddler are typically designed to hold 4-6 oz of liquid. A cup with only a couple ounces of liquid requires the child to mindfully manipulate the cup, by changing the angle of the cup, to continue to obtain liquid. Learning to tip the cup upward to continue finding liquid until the cup is empty requires much practice because the child needs to learn to tilt the cup upward and their heads backward at the same time.

A full cup of liquid mitigates this problem by decreasing the need for the child to angle the cup or their head. This results in countless wasted ounces of liquid because a young toddler may not drink more than an ounce at a time. Young toddlers beginning training with a cup may take only a few sips, but still the cup needs to be full to reinforce their efforts.

One way to reduce the waste associated with providing a full cup to a toddler is to use cups with smaller volumes. Using cups as small as the amount of liquid a toddler is likely to drink is impractical and expensive. Also, such a small cup (1 to 2 oz.) is likely to be difficult for a child to hold, thus creating a new problem with learning to use a toddler cup. For the benefit and ease of use of the toddler cup, children are best served by being able to hold a cup of normal size.

Another important issue parents face in raising our children is nutrition. Drinking too much juice or other high calorie liquids is a contributing factor to the crisis of obesity. Therefore, it is crucial for parents to be able to easily and accurately provide toddlers with well measured amounts of calorie-laden drinks.

As such, there remains a need in the art for cups which can help a child become accustomed to drinking from a regular cup.

SUMMARY OF THE INVENTION

Embodiments of the invention may help toddlers cup train by allowing them to hold a full size cup while minimizing the headspace above the liquid. Additional embodiments allow a child to use a regular cup while being limited in the amount of calorie-laden drinks they consume. Embodiments of the invention may also allow parents to vary the amounts of liquids provided to their children, depending on age and the need at the time. This may result in monetary savings by reducing wasted liquids and the need to purchase multiple cups of various sizes.

FIG. 1 shows a full-sized toddler cup 10 with a spill-resistant lid 12 according to conventional art. It can be seen that when there is a small amount of liquid 14, relative to the volume of the cup 10 a large amount of air 16 is present. The air 16 may then be easily ingested by the drinker through the spill-resistant lid 12.

A cup 20 of one or more embodiments of the invention is shown in FIG. 2. By modifying the volume of the cup 20, in this case, by moving the bottom 28 of the cup 20 toward the lid 22, the amount of air 26 remaining in the cup 20 can be minimized. It can also be seen that the liquid 24 within the cup 20 covers more of the spill-resistant lid 22, thereby minimizing the amount of air ingested and reducing the likelihood of a child becoming ill.

Accordingly, one or more embodiments of the invention are directed toward variable volume cups. The cup of some embodiments comprises a housing having an inside surface and an outside surface. The housing is adapted to retain a substance. Retention may be effected in many ways. Some non-limiting examples include a separate bottom surface inside the cup (i.e., a cup that is shaped roughly like a soup can with one end removed), the inside surface can be frustum shaped, or the inside surface could taper to a point. The cup of some embodiments has at least one removable insert. The removable inserts may have an inside surface and an outside surface. The insert is adapted to fit within the housing and retain a substance.

Various embodiments of the invention have a removable cap adapted to fit on the cup. The removable cap of some embodiments comprises a spill-proof mechanism so a child can use the cup without risking spilling the contents. One skilled in the art will be familiar with spill-proof mechanisms which can be used with embodiments of the invention.

Further embodiments have a series of inserts stacked within the cup. Each insert can be stacked within either the cup housing or another insert within the housing. As an example of the stackable insert embodiments, a 12 oz. cup housing may have inserts which decrease the volume to 10, 8, 6 and 4 oz. Any single or combination of inserts can be employed by various aspects of the invention.

Some embodiments of the invention have handles attached to the housing. Other embodiments have handles attached to removable inserts. Handles attached to the inserts are accessible to a human hand when the at least one insert is within the housing. The handles attached to the inserts of multiple embodiments stack within the handles of subsequent inserts.

The housing of various embodiments comprises a gap between the inside surface and outside surface. Other embodiments have a gap between the outer surface and inner surface of the at least one removable insert. The gaps of these embodiments may be adapted to contain a substance. The substance of some embodiments can be frozen in a manner similar to an ice pack. This will serve to keep the contents of the cup cold.

Further embodiments of the invention are directed to a cup comprising an elongated housing having an inside surface and an outside surface. A bottom may be fitted within the housing in contact with the inside surface of the housing. A means for adjusting the location of the bottom within the inside of the housing is incorporated into certain embodiments. The inside surface and the bottom of these embodiments form a structure adapted for retaining a substance. The structure has a volume and a means for preventing a retained substance from passing between the inside surface and the bottom. The volume contained within the structure can be changed.

The means for adjusting the height of the bottom of the cup in various embodiments of the invention can be a screw-type mechanism, a slide mechanism, or combinations thereof. The screw-type mechanism can be, but is not required to be, attenuated by twisting a bottom portion of the housing, or some other radial motion. The slide-type mechanism can be, but is not required to be, a mechanism similar to a syringe plunger, but any mechanism requiring at least some axial force falls within the scope of embodiments of the invention.

Embodiments of the invention may incorporate handles which are accessible to a human hand to grip the cup.

Other embodiments have a gap between the inside surface and outside surface of the housing. The gap can hold a substance which may be adapted to retain either heat or cold, depending on the desired attributes for the liquid to be held. Some embodiments may have an insulating material on the outside of the housing. Other embodiments may have a housing having different materials on the inside surface and outside surface, allowing a person to hold the cup without their hand getting too cold or hot, depending on the contents of the cup.

Further embodiments of the invention are directed toward methods of using an adjustable volume cup. An insert having an inside surface and an outside surface may be placed within a housing. The housing also having an inside surface and an outside surface, so that the outside surface of the insert is in proximity to the inside surface of the housing. Both the housing and the insert are adapted to hold a substance.

Additional embodiments include attaching a cap having an opening for drinking to the housing. Further embodiments have a spill-proof mechanism incorporated into the cap.

Other embodiments further comprise the step of placing at least one second insert having an inside surface and an outside surface within the first insert so that the outside surface of the at least one second housing is in proximity to the inside surface of the first insert. Still further embodiments have a series of inserts stacked within each other, each subsequent insert decreasing the volume that the cup can hold.

Other embodiments are directed toward a method of using an adjustable volume cup, comprising filling a cup with a desired amount of liquid. The cup having an outside surface, an inside surface and a bottom in contact with the inside surface. The bottom is adapted to prevent liquid from passing between the inside surface of the cup and the bottom. The location of the bottom of the cup is adjusted, thereby determining the volume which the cup can hold.

Further embodiments include the step of attaching a cap having an opening for drinking to the housing. Still further embodiments incorporate a spill-resistant mechanism to the cap.

Various embodiments of the method include the step of freezing a substance located between the outside surface and the inside surface of the cup. The substance can also be heated to keep

DETAILED DESCRIPTION OF THE INVENTION

Before describing several exemplary embodiments of the invention, it is to be understood that the invention is not limited to the details of construction or process steps set forth in the following description. The invention is capable of other embodiments and of being practiced or being carried out in various ways.

As used in this specification and the appended claims, the singular forms "a", "an" and "the" include plural referents unless the context clearly indicates otherwise. Thus, for example, reference to "an insert" includes a mixture of two or more inserts, and the like.

Figure 1:
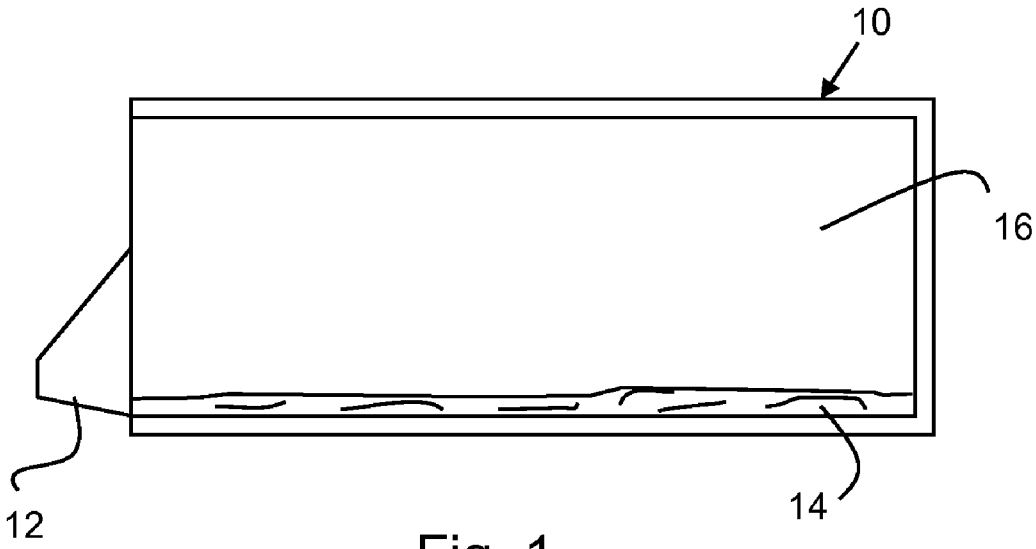
Fig. 1 (prior art)
FIG. 1 shows a convention drinking cup.
Figure 2:
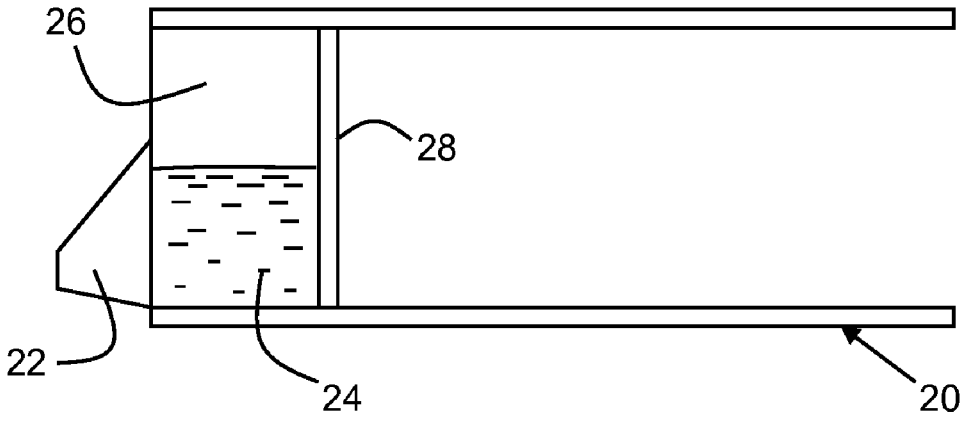
FIG. 2 shows a cup according to one embodiment.
Figure 3:
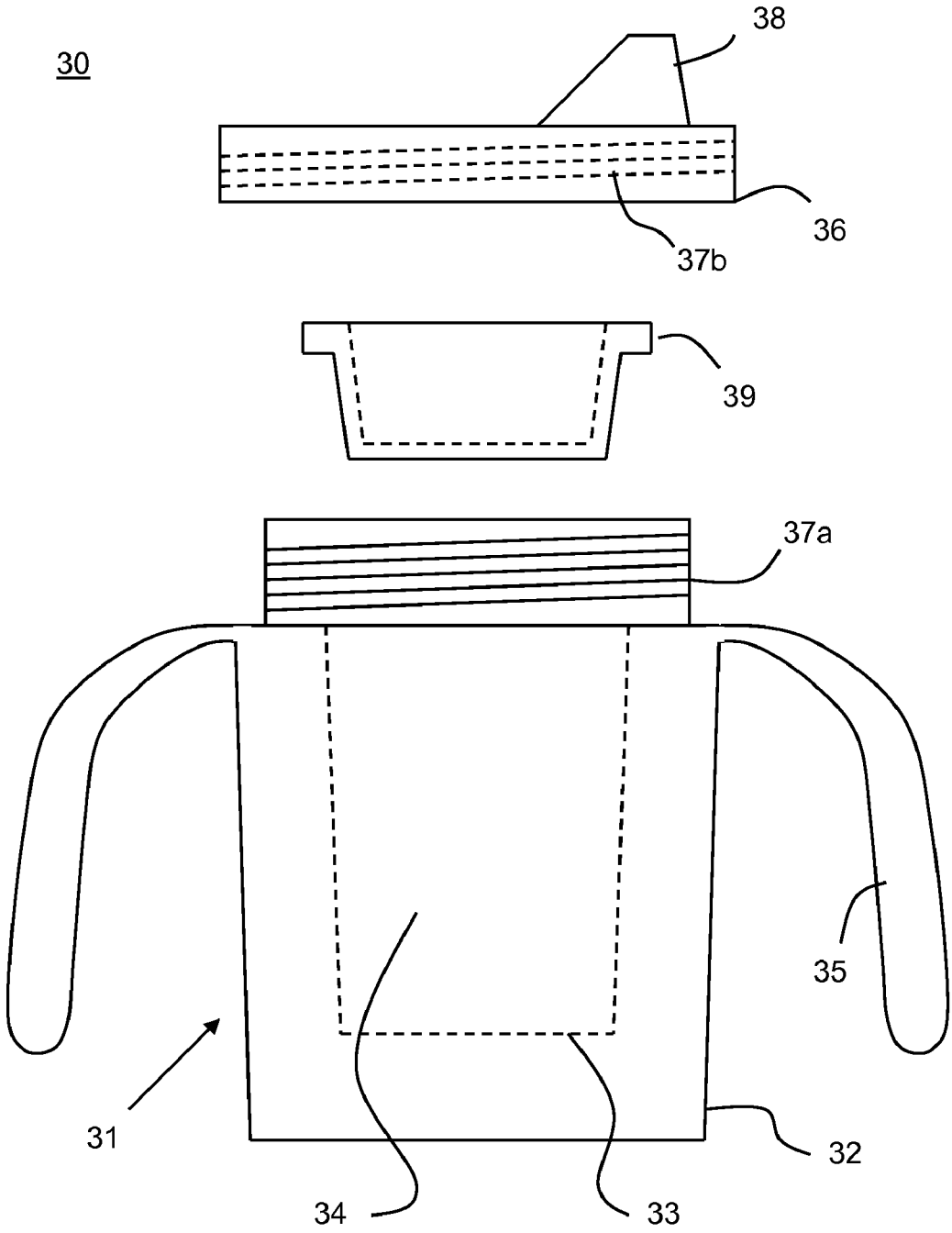
FIG. 3 shows a cross-sectional view of a drinking cup according to another embodiment.

FIG. 3 shows a drinking cup according to one or more embodiments of the invention. The cup 30 shown, has a housing 31 with an exterior surface 32 and an interior surface 33 which define a volume 34. The housing 31 can be any shape, as desired by the specific cup design. Handles 35 are attached to the housing 31. A mechanism for attaching a top 36 is included, in this case it is a series of screw threads 37*a*, 37*b*. The top 36 may include a mouthpiece 38 adapted to be placed in the mouth for sipping. An insert 39 is shown which can be placed within the housing 31 to decrease the available volume for holding a liquid.

Figure 4:
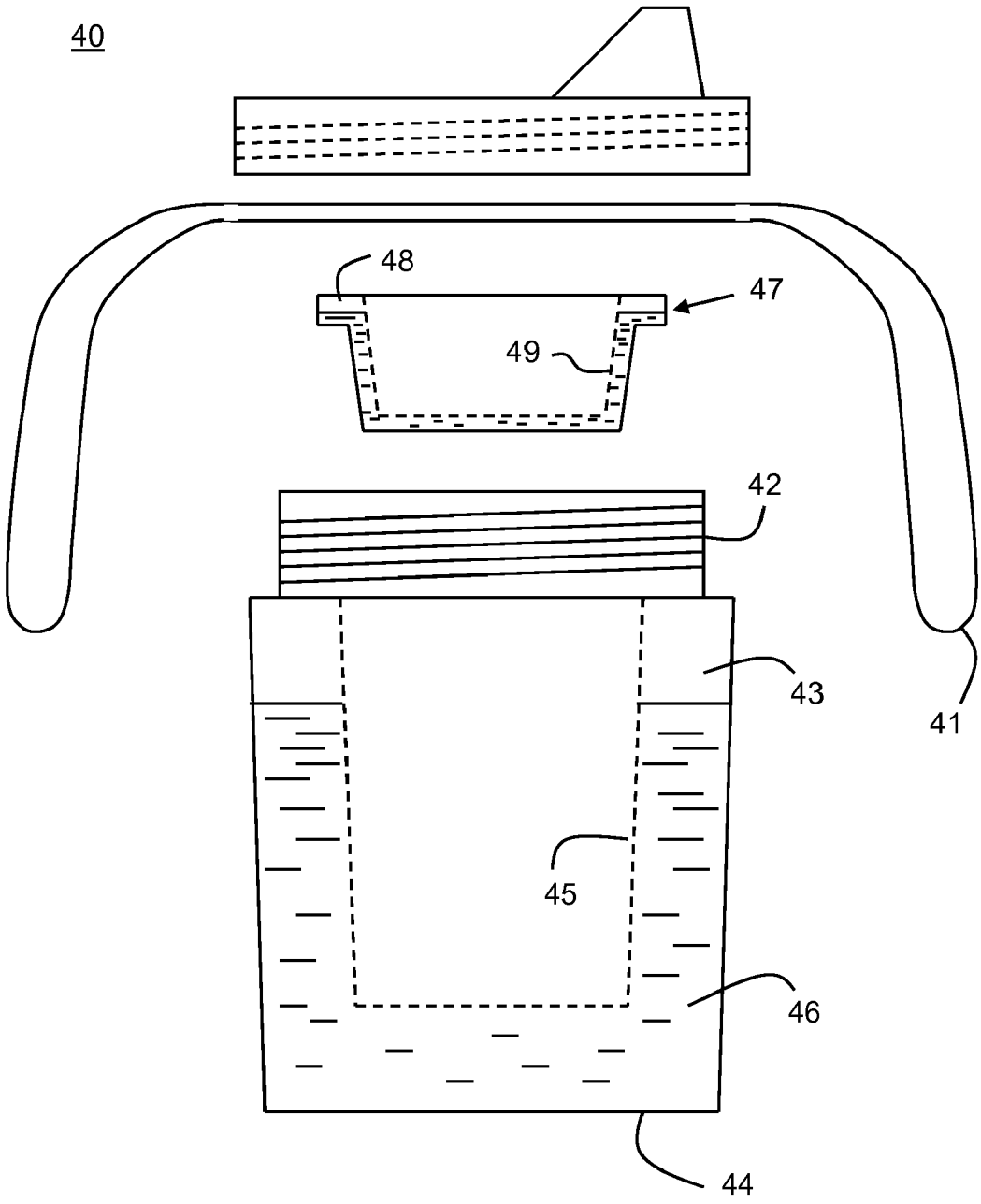
FIG. 4 shows a cross-sectional view of a drinking cup according to another embodiment.

FIG. 4 shows a drinking cup 40 according to other embodiments. The handles 41 of this embodiment are a separate piece which may be attached to the cup 40. For example, the handles 41 may slide over a threaded section 42 at the top of the cup 40. A gap 43 between the housing exterior 44 and the housing interior 45 may be filled with a substance 46. This substance 46 may have a higher heat capacity than water, such that it will retain temperature longer than water. For example, the substance 46 may be frozen, thereby causing the contents of the cup to be kept cold. By using a substance with a higher heat capacity than water, the cup will substance 46 will retain its temperature longer. The insert 47 may also have a gap 48 which can be filled with a similar substance 49. The cup and/or the insert 47 can be filled with the substance.

Figure 5:
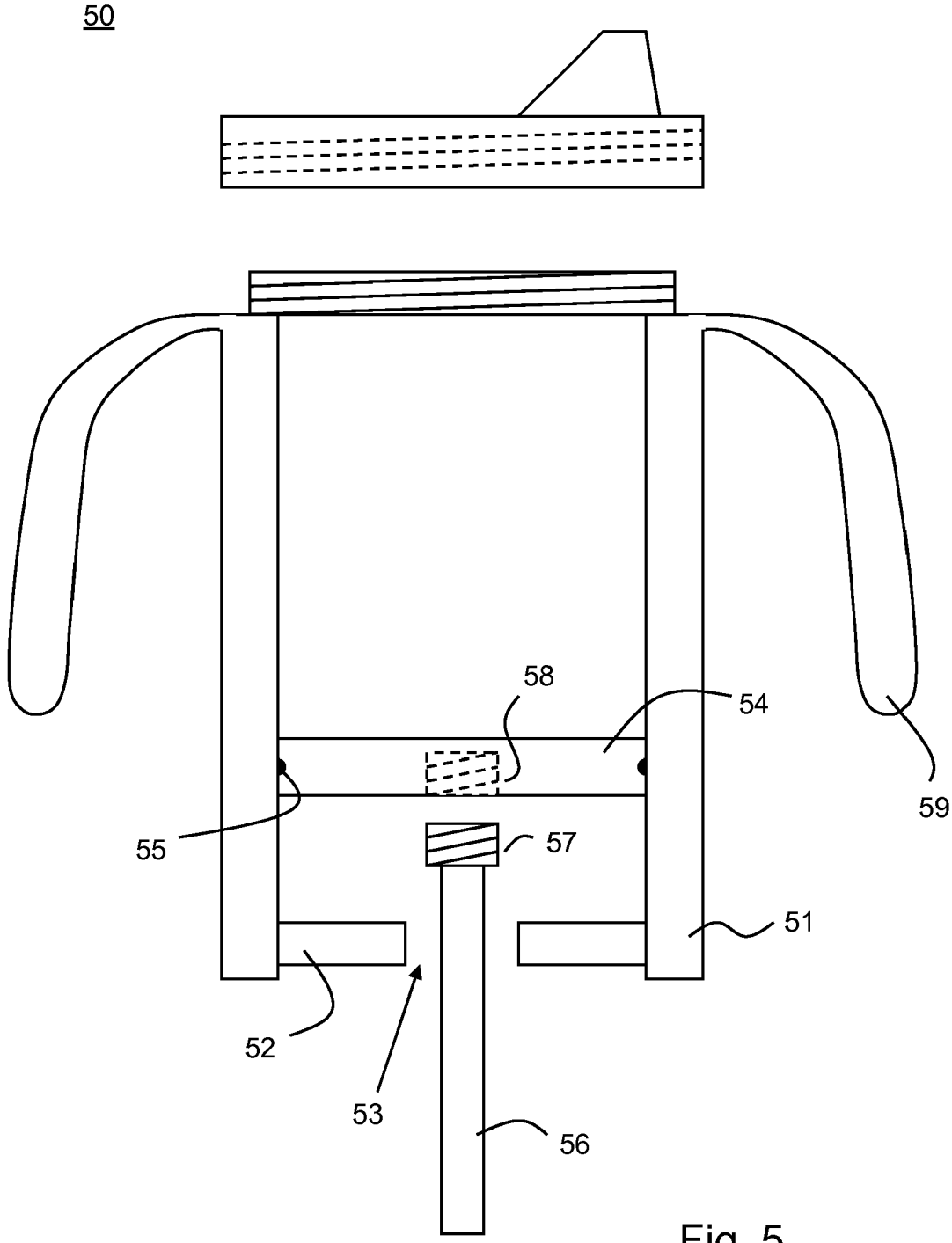
FIG. 5 shows a cross-sectional view of a drinking cup according to another embodiment.

FIG. 5 shows a drinking cup 50 according to further embodiments. The cup 50 of these embodiments has sides 51 and a bottom 52. The bottom 52 has an opening 53 which allows access to a sliding bottom 54. The sliding bottom 54 forms a seal with the inside of the wall 51 with a suitable sealing mechanism, in this case an o-ring 55 is used. The location of the sliding bottom 54 in the embodiment shown can be adjusted by inserting a rod 56 having a rod end 57 through the opening 53 and into a slot 58 in the sliding bottom 54. The rod end 57 can be fixed within the slot 58 allowing the sliding bottom 54 to be moved within the cup 50. Once the sliding bottom 54 has been moved to the desired location, the rod end 57 can be disengaged from the slot 58 and the rod 56 removed. The cup 50 of some embodiments has integral handles 59 with the cup 50 body.

Figure 6:
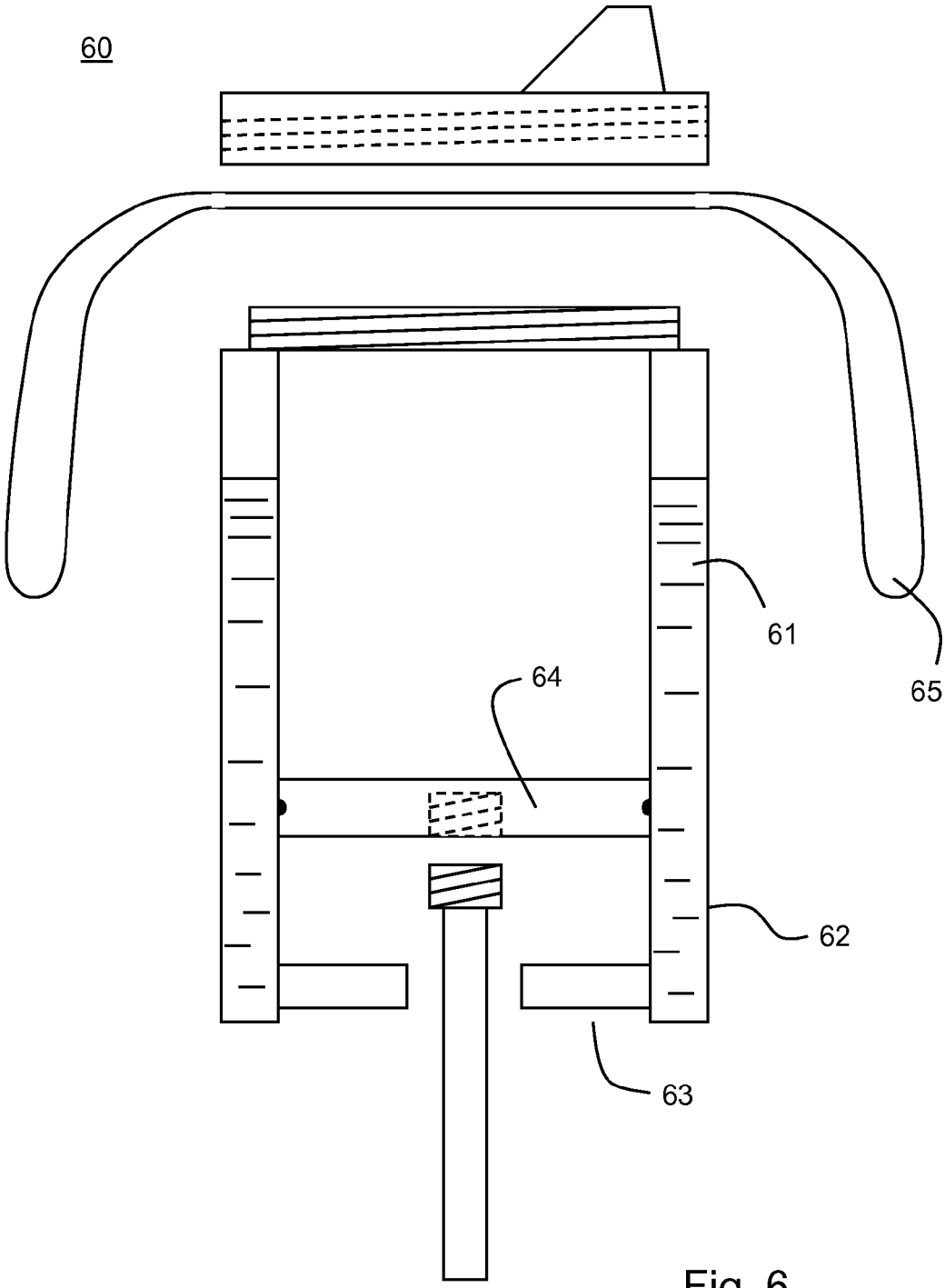
FIG. 6 shows a cross-sectional view of a drinking cup according to another embodiment.

FIG. 6 shows another cup 60 having a substance 61 within the walls 62 of the cup 60. The substance can also be located within the bottom 63 and the sliding bottom 64, as desired. The handles 65 of some embodiments can be a separate piece which may or may not be used with the cup 60.

Figure 7:
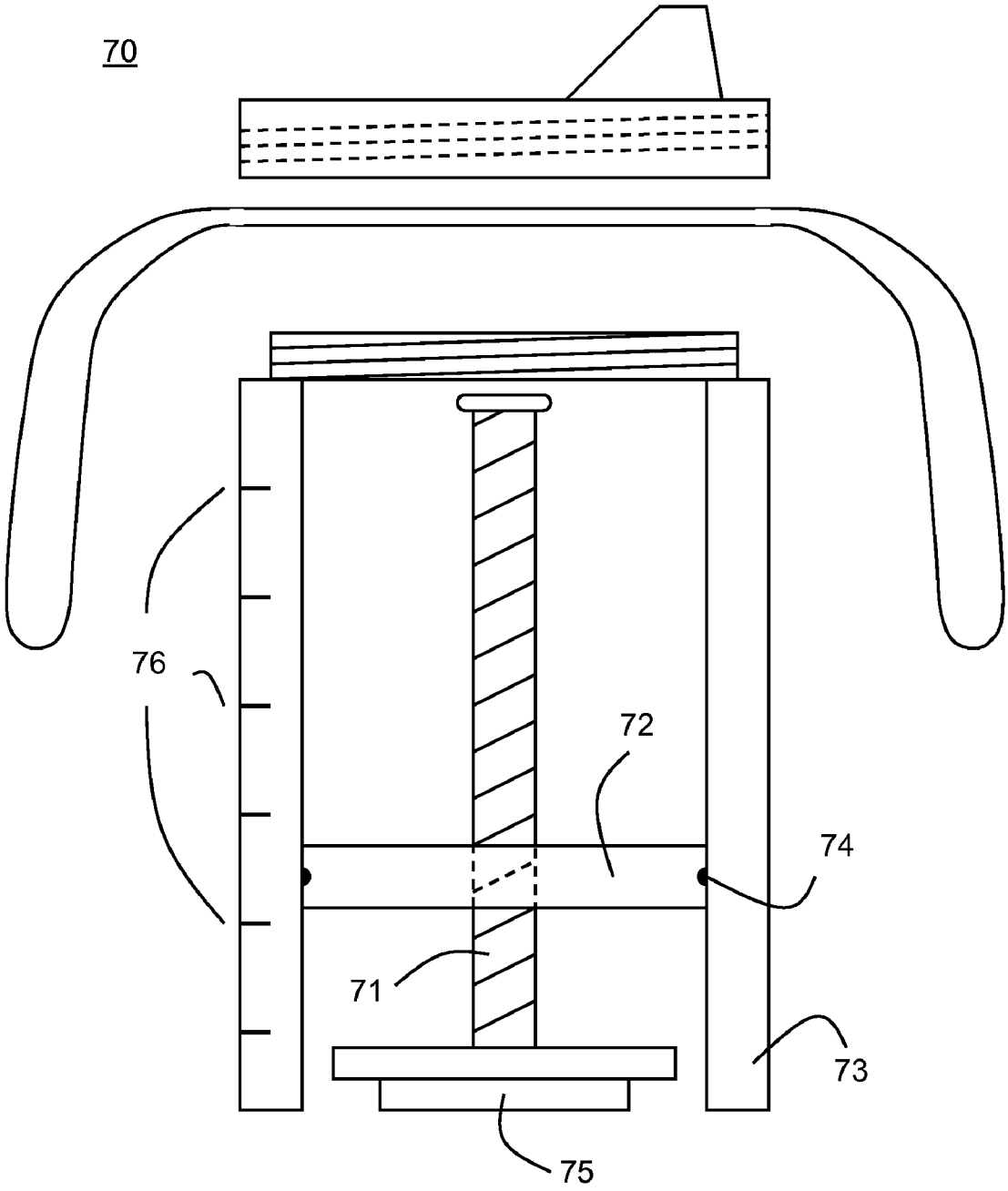
FIG. 7 shows a cross-sectional view of a drinking cup according to another embodiment.

The cup 70 of FIG. 7 uses a threaded rod 71 mechanism to adjust the location of the sliding bottom 72 within the cup walls 73. The sliding bottom 72 forms a seal with the cup walls 73 using a suitable sealing means. The sealing means shown in this drawing is an o-ring 74, but can be others. The location of the sliding bottom 72 can be adjusted by turning a handle 75 on the base of the cup 70. The threaded rod 71 in this embodiment occupies space within the inside of the cup 70. The walls 73 have markings 76 which can be read from the outside of the cup. The markings 76 can be used to indicate the volume that the cup 70 can hold. Thus, the sliding bottom 72 of the cup 70 can be positioned such that it aligns with one of the marks 76. Then the cup 70 will only be able to hold the amount of liquid shown on the mark 76. The threaded rod 71 of some embodiments holds a substance which can be frozen or heated.

Figure 8A:
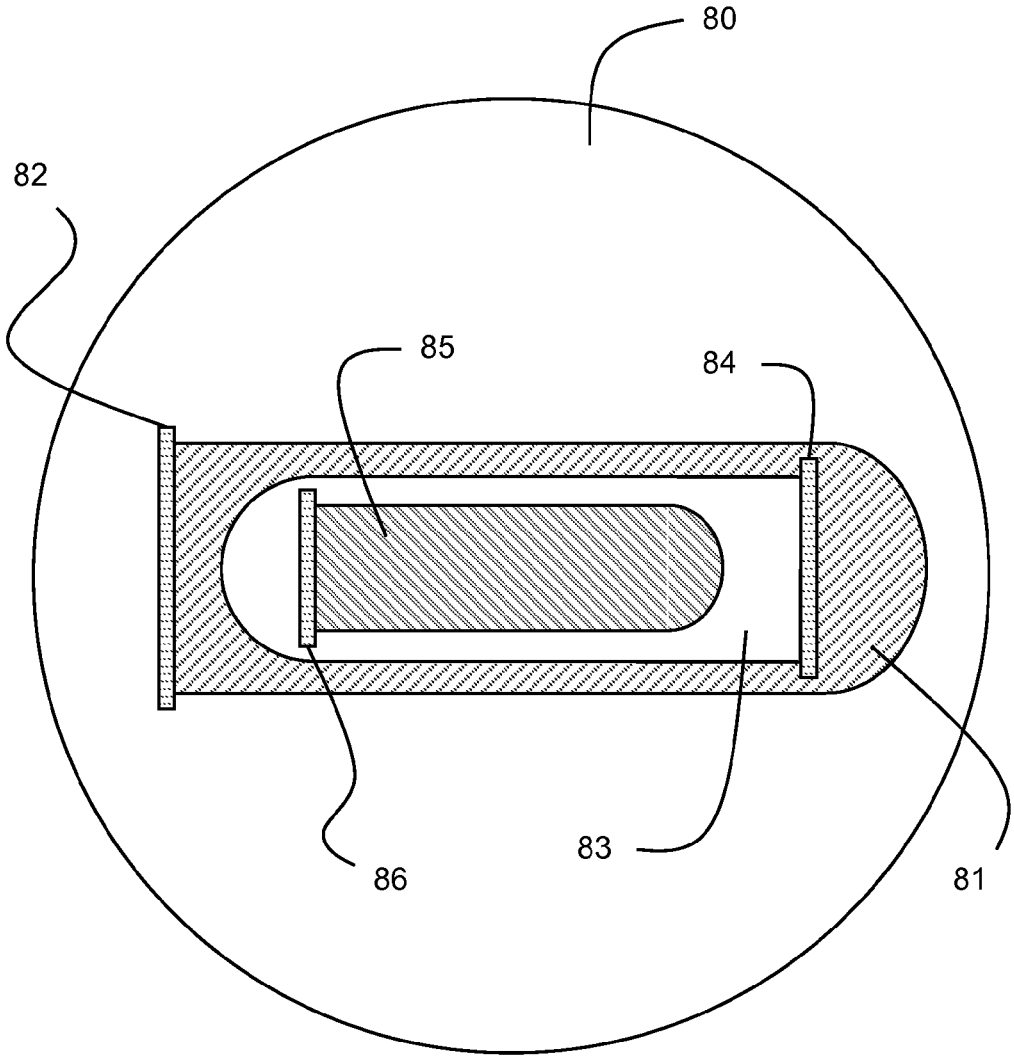
FIGS. 8A and 8B show a mechanism for moving a cup bottom according to another embodiment.
Figure 8B:
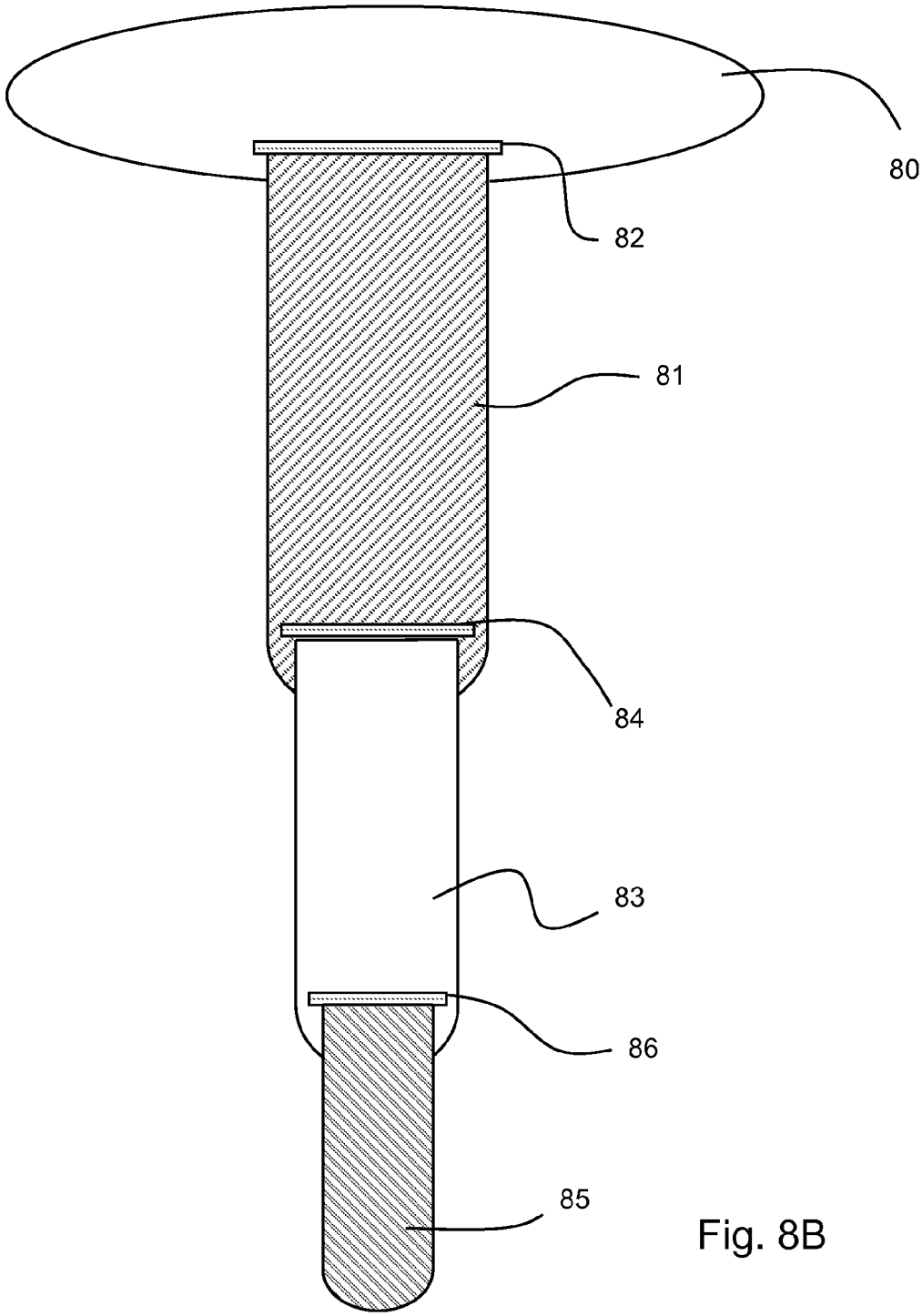

FIG. 8A shows a view of a cup bottom 80 according to some embodiments. The bottom 80 has a series of tabs 81, 83, 85 which fold out on pivot pins 82, 84, 86. FIG. 8B shows a view of the same cup bottom 80 with the tabs 81, 83, 85 extended. By extending the tabs to the fully extended position, as shown in FIG. 8B, the user can pull or push on the tabs to cause the bottom of the cup 80 to move, thereby adjusting the volume of liquid that a cup can contain. The tabs shown are illustrative only, and the shape can be modified to suit any desired aesthetic or functional need.

Accordingly, one or more embodiments of the invention are directed toward variable volume cups. The cup of some embodiments comprises a housing having an inside surface and an outside surface. The housing may be any shape, for example, an elongated cylinder, elongated octagon, or cubic. The housing is adapted to retain a substance being either a solid, liquid or gas. Retention may be effected in many ways. Some non-limiting examples include a separate bottom surface inside the cup (i.e., a cup that is shaped roughly like a soup can with one end removed), the inside surface can be frustum shaped, or the inside surface could taper to a point. The cup of some embodiments has at least one removable insert. The removable inserts have an inside surface and an outside surface. The inserts are adapted to fit within the housing and retain a substance.

Various embodiments of the invention have a removable cap adapted to fit on the cup. The removable cap of some embodiments comprises a spill-proof mechanism allowing a child to use the cup without risk of spilling the contents. One skilled in the art will be familiar with spill-proof mechanisms which can be used with embodiments of the invention.

Further embodiments have a series of inserts stacked within the cup. Each insert can be stacked within either the cup housing or within another insert within the housing. As an example of the stackable insert embodiments, a 12 oz. cup housing may have inserts which decrease the volume to 10, 8, 6 and 4 oz. Any single, or combination, of inserts can be employed by various aspects of the invention.

Some embodiments of the invention have handles attached to the housing. Other embodiments have handles attached to removable inserts. Handles attached to the inserts are accessible to a human hand when the at least one insert is within the housing. The handles attached to the inserts of multiple embodiments may stack within the handles of subsequent inserts.

The housing of various embodiments has a gap between the inside surface and outside surface. Other embodiments have a gap between the outer surface and inner surface of the at least one removable insert. The gaps of these embodiments may be adapted to contain a substance. The substance of some embodiments can be frozen in a manner similar to an ice pack. This will serve to keep the contents of the cup cold. In detailed embodiments the substance has a heat capacity that is higher than that of water.

Further embodiments of the invention are directed to a cup comprising an elongated housing having an inside surface and an outside surface. A bottom may be fitted within the housing in contact with the inside surface of the housing. A means for adjusting the location of the bottom within the inside of the housing is incorporated into certain embodiments. The inside surface and the bottom of these embodiments form a structure adapted for retaining a substance. The structure has a volume and a means for preventing a retained substance from passing between the inside surface and the bottom. The volume contained within the structure can be changed.

The means for adjusting the height of the bottom of the cup in various embodiments of the invention can be a screw-type mechanism, a slide mechanism, or combinations thereof. The screw-type mechanism can be, but is not required to be, attenuated by twisting a bottom portion of the housing, or some other radial motion. The screw mechanism can hold a substance adapted to be frozen or heated. The slide-type mechanism can be, but is not required to be, a mechanism similar to a syringe plunger, but any mechanism requiring at least some axial force falls within the scope of embodiments of the invention.

In a detailed embodiment, the cup bottom has a handle that can fold into the bottom. The handle of these embodiments can be extended, allowing the user to control the location of the bottom of the cup by pushing or pulling on the extended handle.

Other embodiments have a gap between the inside surface and outside surface of the housing. The gap can hold a substance which may be adapted to retain either heat or cold, depending on the desired attributes for the liquid to be held. Some embodiments may have an insulating material on the outside of the housing. Other embodiments may have a housing having different materials on the inside surface and outside surface, allowing a person to hold the cup without their hand getting too cold or hot, depending on the contents of the cup.

Further embodiments of the invention are directed toward methods of using an adjustable volume cup. An insert having an inside surface and an outside surface may be placed within a housing. The housing also having an inside surface and an outside surface, so that the outside surface of the insert is in proximity to the inside surface of the housing. Both the housing and the insert are adapted to hold a substance.

Additional embodiments include attaching a cap to the housing. The cap may have an opening for drinking. Detailed embodiments have a spill-proof mechanism incorporated into the cap.

Other embodiments comprise the step of placing at least one second insert having an inside surface and an outside surface within the first insert so that the outside surface of the at least one second housing is in proximity to the inside surface of the first insert. Still further embodiments have a series of inserts stacked within each other, each subsequent insert decreasing the volume that the cup can hold.

Other embodiments are directed toward a method of using an adjustable volume cup, comprising filling a cup with a desired amount of liquid. The cup having an outside surface, an inside surface and a bottom in contact with the inside surface. The bottom is adapted to prevent liquid from passing between the inside surface of the cup and the bottom. The location of the bottom of the cup is adjusted, thereby determining the volume which the cup can hold. The location of the cup bottom can be adjusted before or after addition of the substance to the cup.

Various embodiments of the method include the step of freezing a substance located between the outside surface and the inside surface of the cup. The substance can also be heated to keep Accordingly, while the present invention has been disclosed in connection with various embodiments thereof, it should be understood that other embodiments might fall within the spirit and scope of the invention, as defined by the following claims.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations that are within the scope of the appended claims and their equivalents.

The invention claimed is:

1. A cup comprising:

a housing having an inside surface and an outside surface, the housing adapted to retain a substance;

at least one removable insert with an inside surface and an outside surface, the insert adapted to fit within the housing and retain a substance, the at least one removable insert has handles attached thereto, the handles accessible when the at least one insert is within the housing.

2. The cup of claim 1, further comprising a removable cap.

3. The cup of claim 1, further comprising handles attached to the housing.

4. The cup of claim 1, wherein at least one removable insert can be stacked within another removable insert.

5. The cup of claim 1, wherein several removable inserts are stacked within the housing.

6. The cup of claim 2, wherein the removable cap comprises a spill resistant mechanism.

7. The cup of claim 1, wherein the housing has a gap between the inside surface and outside surface, the gap being adapted to contain a substance.

8. The cup of claim 7, further comprising a substance contained within the gap, the substance being able to be frozen.

9. The cup of claim 1, wherein the at least one removable insert has a gap between the outer surface and inner surface, the gap being adapted to contain a substance.

10. The cup of claim 9, further comprising a substance contained within the gap, the substance being able to be frozen.

11. The cup of claim 1, wherein the cup and/or inserts have markings denoting the volume.

12. A cup comprising:

a housing having an inside surface and an outside surface; and a bottom fitted within the housing in contact with the inside surface where the inside surface of the housing and the bottom form a structure adapted for retaining a substance, the bottom positioned within the housing at a location defining a volume that can be held within the housing, the bottom being adapted to be moved within the housing to change the volume, the position of the bottom being adjustable by one or more of sliding and screwing.

13. The cup of claim 12, further comprising handles.

14. The cup of claim 12, further comprising a gap between the inside surface and outside surface, the gap being adapted to hold a substance.

15. The cup of claim 14, wherein the substance can be frozen.

16. A method of using an adjustable volume cup, comprising:

filling a cup with a desired amount of liquid, the cup having an outside surface, an inside surface and a bottom in contact with the inside surface, the inside surface and the bottom defining a volume to be held by the cup, the bottom adapted to prevent liquid from passing between the inside surface of the cup and the bottom; and adjusting the location of the bottom of the cup to change the volume defined by the inside surface and the bottom, the adjustment being made by one or more of a sliding action or screwing action.

17. The method of claim 16, further comprising attaching a cap having an opening for drinking to the housing.

18. The method of claim 16, further comprising freezing a substance located between the outside surface and the inside surface of the cup.

* * * * *